US007025152B2

(12) United States Patent
Sharp et al.

(10) Patent No.: US 7,025,152 B2
(45) **Date of Patent: *Apr. 11, 2006**

(54) USING A ROTATING INNER MEMBER TO DRIVE A TOOL IN A HOLLOW OUTER MEMBER

(75) Inventors: Richard Felix Sharp, Perry, OK (US); Matthew L. Dock, Stillwater, OK (US)

(73) Assignee: The Charles Machine Works, Inc., Perry, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/853,028

(22) Filed: May 21, 2004

(65) Prior Publication Data

US 2005/0056460 A1 Mar. 17, 2005

Related U.S. Application Data

(63) Continuation of application No. 10/047,664, filed on Jan. 15, 2002, now Pat. No. 6,739,413.

(51) Int. Cl.
*E21B 7/04* (2006.01)

(52) U.S. Cl. ..... 175/61; 175/62; 175/73; 175/256

(58) Field of Classification Search ..... 175/61, 175/62, 73, 74–99, 256
See application file for complete search history.

(56) References Cited

U.S. PATENT DOCUMENTS

| | | | | |
|---|---|---|---|---|
| 2,819,039 A | | 1/1958 | Lindsay et al. | 255/1.6 |
| 3,065,807 A | | 11/1962 | Wells | 175/321 |
| 3,077,937 A | | 2/1963 | Tiraspolosky et al. | 175/107 |
| 3,448,305 A | | 6/1969 | Raynal et al. | 310/17 |
| 3,583,502 A | | 6/1971 | Henderson | 175/107 |
| 3,638,970 A | | 2/1972 | Sandquist et al. | 285/24 |
| 3,747,698 A | * | 7/1973 | Chapman | 175/92 |
| 3,819,293 A | | 6/1974 | Zitzmann | 415/200 |
| 3,949,354 A | | 4/1976 | Claycomb | 340/18 |
| 3,970,335 A | * | 7/1976 | Curington et al. | 285/123.3 |
| 3,970,877 A | | 7/1976 | Russell et al. | 310/8.3 |
| 3,982,224 A | | 9/1976 | Patton | 340/18 |
| 3,997,867 A | | 12/1976 | Claycomb | 340/18 |
| 3,998,479 A | | 12/1976 | Bishop | 285/133 |
| 4,012,061 A | | 3/1977 | Olson | 285/133 |
| 4,080,112 A | | 3/1978 | Zimmermann | 417/420 |
| 4,184,545 A | | 1/1980 | Claycomb | 166/113 |
| RE30,246 E | | 4/1980 | Richter, Jr. et al. | 175/65 |
| 4,207,485 A | | 6/1980 | Silver | 310/104 |
| 4,215,426 A | | 7/1980 | Klatt | 367/83 |
| 4,244,431 A | * | 1/1981 | Johnson | 175/320 |
| 4,351,037 A | | 9/1982 | Scherbatskoy | 367/85 |

(Continued)

FOREIGN PATENT DOCUMENTS

DE 42 25 701 C1 12/1993

(Continued)

*Primary Examiner*—Frank S. Tsay
(74) *Attorney, Agent, or Firm*—Tomlinson & O'Connell, PC

(57) ABSTRACT

A rotating inner member is used to drive a downhole tool housed within the hollow outer member of a dual-member drill string. The downhole tool preferably will be adapted to receive rotational energy from the inner member. In a preferred embodiment, the downhole tool is an electric generator connected to a downhole electric device. In another preferred embodiment the downhole tool is a mechanical transmission that uses the rotational energy from the inner member to drive a non-electric tool, such as a downhole hammer. This invention will increase the consistency and efficiency of downhole energy production.

26 Claims, 10 Drawing Sheets

U.S. PATENT DOCUMENTS

| | | | | |
|---|---|---|---|---|
| 4,491,738 | A | 1/1985 | Kamp | 290/43 |
| 4,515,225 | A | 5/1985 | Dailey | 175/40 |
| 4,518,888 | A | 5/1985 | Zabcik | 310/334 |
| 4,532,614 | A | 7/1985 | Peppers | 367/81 |
| 4,654,537 | A | 3/1987 | Gaspard | 290/54 |
| 4,675,852 | A | 6/1987 | Russell et al. | 367/84 |
| 4,725,197 | A | 2/1988 | Russell et al. | 415/104 |
| 4,739,325 | A | 4/1988 | MacLeod | 340/854 |
| 4,785,300 | A | 11/1988 | Chin et al. | 340/861 |
| 4,802,150 | A | 1/1989 | Russell et al. | 367/85 |
| 4,834,193 | A | 5/1989 | Leitko, Jr. et al. | 175/19 |
| 4,844,707 | A | 7/1989 | Kletschka | 417/420 |
| 4,847,815 | A | 7/1989 | Malone | 367/84 |
| 4,850,440 | A | 7/1989 | Smet | 175/67 |
| 5,040,601 | A | 8/1991 | Karlsson et al. | 166/278 |
| 5,101,918 | A | 4/1992 | Smet | 175/424 |
| 5,145,333 | A | 9/1992 | Smith | 417/405 |
| 5,149,984 | A | 9/1992 | Schultz et al. | 290/54 |
| 5,179,040 | A | 1/1993 | Hattori | 437/129 |
| 5,182,731 | A | 1/1993 | Hoelscher et al. | 367/84 |
| 5,215,152 | A | 6/1993 | Duckworth | 175/48 |
| 5,248,896 | A | 9/1993 | Forrest | 290/1 |
| 5,285,204 | A | 2/1994 | Sas-Jaworsky | 340/854.9 |
| 5,361,855 | A | 11/1994 | Schuermann et al. | 175/67 |
| 5,402,068 | A | 3/1995 | Meador et al. | 324/338 |
| 5,423,388 | A | 6/1995 | Hale | 175/74 |
| 5,439,064 | A | 8/1995 | Patton | 175/24 |
| 5,448,227 | A | 9/1995 | Orban et al. | 340/854.4 |
| 5,467,831 | A | 11/1995 | Spektor | 175/19 |
| 5,490,569 | A | 2/1996 | Brotherton et al. | 175/61 |
| 5,583,827 | A | 12/1996 | Chin | 367/84 |
| 5,586,083 | A | 12/1996 | Chin et al. | 367/84 |
| 5,615,172 | A | 3/1997 | Kotlyar | 367/83 |
| 5,682,956 | A | 11/1997 | Deken et al. | 175/19 |
| 5,695,015 | A | 12/1997 | Barr et al. | 175/45 |
| 5,782,311 | A | 7/1998 | Wentworth | 175/53 |
| 5,787,052 | A | 7/1998 | Gardner et al. | 367/84 |
| 5,812,068 | A | 9/1998 | Wisler et al. | 340/855.5 |
| 5,813,480 | A | 9/1998 | Zaleski, Jr. et al. | 175/40 |
| 5,818,352 | A | 10/1998 | McClure | 340/854.6 |
| 5,839,508 | A | 11/1998 | Tubel et al. | 166/65.1 |
| 5,957,222 | A | 9/1999 | Webb et al. | 175/45 |
| 2002/0084109 | A1 | 7/2002 | Runquist et al. | 175/61 |

FOREIGN PATENT DOCUMENTS

| | | |
|---|---|---|
| EP | 0 674 093 A2 | 9/1995 |
| JP | 260192 | 10/1989 |

* cited by examiner

USING A ROTATING INNER MEMBER TO DRIVE A TOOL IN A HOLLOW OUTER MEMBER

CROSS REFERENCE TO RELATED APPLICATION

This application is a continuation of U.S. application Ser. No. 10/047,664 filed Jan. 15, 2002, now U.S. Pat. No. 6,739,413.

FIELD OF THE INVENTION

This invention relates generally to rotary driven tools, and in particular to downhole tools in horizontal directional drilling operations.

BACKGROUND OF THE INVENTION

In horizontal directional drilling operations it is desirable to provide power to several and various downhole drilling components. Batteries, wire-line connections, and downhole fluid-driven generators have been employed to provide power to the downhole components. However, there remains a need for improvement.

SUMMARY OF THE INVENTION

The present invention is directed to a horizontal directional drilling machine. The machine comprises a rotary drive system and a drill string. The drill string is operatively connected to the rotary drive system to drive rotation of the drill string. The drill string comprises a plurality of dual-member pipe sections. Each section comprising a hollow outer member and an inner member positioned longitudinally therein. A downhole tool is supported within at least one of the dual-member pipe sections so that rotation of the inner member will drive operation of the downhole tool.

The present invention further comprises a pipe section assembly for use in a drill string comprising a plurality of dual-member pipe sections. Each dual-member pipe section comprises a hollow outer member and an inner member positioned longitudinally therein. The outer member is connectable with the outer members of adjacent pipe sections, and the inner member is connectable with the inner members of adjacent pipe sections. The interconnected inner members are rotatable independently of the interconnected outer members. The pipe section assembly comprises an elongate, hollow outer member interconnectable with the outer member of at least one of the dual-member pipe sections in the drill string; an elongate inner member arranged longitudinally within the outer member and is interconnectable with the inner member of at least one of the dual-member pipe sections in the drill string and rotatable independently of the outer member. The pipe section assembly comprises a downhole tool supported within the outer member and operatively connectable with the inner member so that rotation of the inner member drives operation of the downhole tool.

Still further, the present invention includes a method for generating power using a horizontal directional drilling machine including a rotary drive system attached to a drill string comprising a plurality of connectable pipe sections. Each pipe section has an inner member disposed longitudinally within a hollow outer member. Each outer member being connectable to another one of the outer members comprising the plurality of pipe sections and each inner, member being connectable to another one of the inner members and rotatable independently of the outer members. The method comprises rotating the interconnected inner members, and converting rotation of the inner member of at least one of the plurality of pipe sections into electric or hydraulic power.

Finally, the present invention includes a power-generating apparatus comprising a hollow outer member; and an inner member positioned within the outer member, and rotatable independently of the outer member; and a power generator supported within the outer member and operatively connectable to the inner member for converting rotational energy from the inner member into electric or hydraulic power.

BRIEF DESCRIPTION OF THE DRAWINGS

FIG. 13 illustrates a tool head in which the downhole tool is a hydraulic pump.

DETAILED DESCRIPTION OF THE PREFERRED EMBODIMENTS

Figure 1:
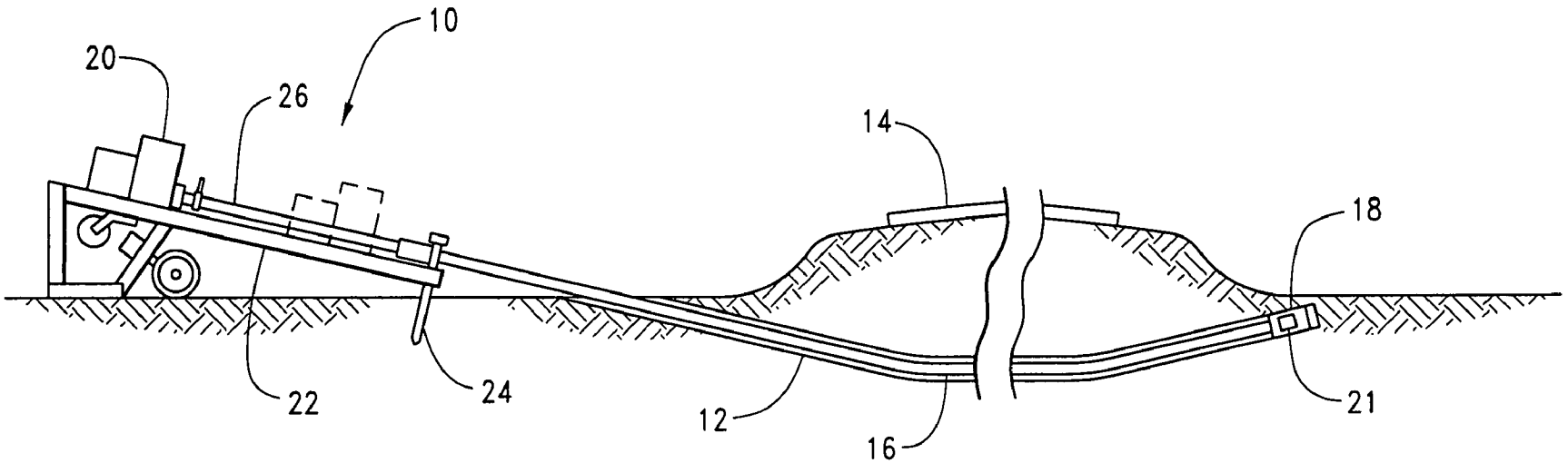
FIG. 1 is a diagrammatic representation of a near surface horizontal directional drilling machine acting on an uphole end of a drill string which, in turn, supports a downhole tool that is constructed in accordance with the present invention.

Turning now to the drawings in general and FIG. 1 in particular, there is shown therein a horizontal directional drilling machine 10 in accordance with the present invention. FIG. 1 illustrates the usefulness of horizontal directional drilling by demonstrating that a borehole 12 can be made without disturbing an above-ground structure, namely the roadway as denoted by reference numeral 14. To cut or drill the borehole 12, a drill string 16 carrying a drill bit 18 is rotationally driven by a rotary drive system 20. As the boring operation advances and the drill bit 18 progresses further through the earth, the ever present difficulty in providing power to various downhole drilling components, such as a locator beacon (not shown), is exacerbated.

The present invention is directed to devices and methods of providing power to downhole drilling components. To provide power to downhole components, a downhole tool 21 is located within the drill string 16. As used herein, "downhole tool" means any one of several devices that are driven by rotation of the inner member to power various downhole drilling components. This, and other advantages associated with the present invention will become apparent from the following description of the preferred embodiments.

Referring still to FIG. 1, the horizontal directional drilling machine 10 generally comprises a frame 22, having an earth anchor 24, for supporting the rotary drive system 20. The rotary drive system 20 is movably supported on the frame 22 between a first position, as shown in FIG. 1, and a second position. Movement of the rotary drive system 20, by way of an axial advancement apparatus (not shown), between the first and second position, axially advances the drill bit 18 and drill string 16 through the borehole 12. The earth anchor 24 is driven into the earth to stabilize the frame 22 and rotary drive system 20 against the counter force exerted by axially advancing the drill bit 18.

The drill string 16 is operatively connected to the rotary drive system 20 at a first end 26. The drill string 16 transmits rotational torque from the rotary drive system 20 to the drill bit 18 and carries drilling fluid into the borehole 12. In the present invention the drill string comprises a dual-member drill string. As used herein the term "dual-member drill string" denotes any drill string used in drilling operations comprising a preferably independently rotatable inner member supported inside an outer member or pipe. In accordance with the present invention, it is preferable to utilize a dual-member drill string comprising a plurality of dual-member pipe sections or pipe joints of which at least one section comprises the downhole tool.

Figure 2:
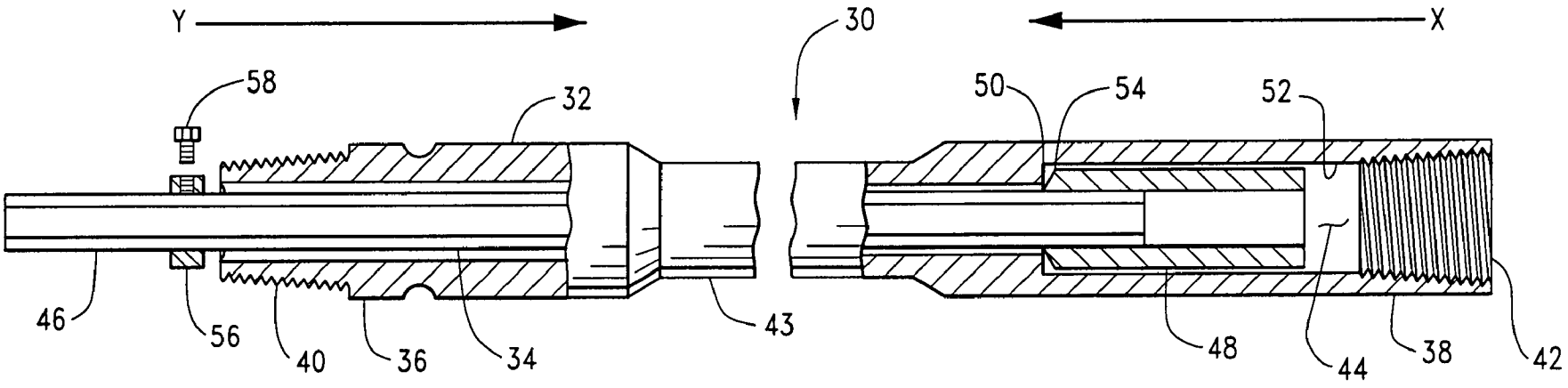
FIG. 2 shows a side elevational, partly sectional view of a first type-pipe section used with a dual-member drill string.

Turning now to FIG. 2, there is shown one of a plurality of dual-member pipe sections 30 comprising the dual-member drill string 16. The dual-member pipe section 30 comprises a hollow outer member 32 and an inner member 34 positioned longitudinally therein. The inner member 34 and outer member 32 are connectable with the inner members and outer members of adjacent dual-member pipe sections to form the dual-member drill string 16. The interconnected inner members 34 are independently rotatable of the interconnected outer members 32 to drive a downhole tool (not shown). It will be appreciated that any dual-member pipe section capable of connecting to adjacent sections of dual-member pipe may be used, but for purposes of illustration, a discussion of exemplary dual-member pipe sections 30 and 30A follows.

The outer member 32 is preferably tubular having a pin end 36 and a box end 38. The pin end 36 and the box end 38 are correspondingly threaded. The pin end 36 is provided with tapered external threads 40, and the box end 38 is provided with tapered internal threads 42. Thus box end 38 of the outer member 32 is connectable to the pin end 36 of a like dual-member pipe section 30. Similarly, the pin end 36 of the outer member 32 is connectable to the box end 38 of a like dual-member pipe section 30.

The external diameter of the pin end 36 and the box end 38 of the outer member 32 may be larger than the external diameter of the central body portion 43 of the outer member 32. The box end 38 of the outer member 32 forms an enlarged internal space 44 for a purpose yet to be described.

The inner member 34 is preferably elongate. In the preferred dual-member pipe section 30, the inner member 34 is integrally formed and comprises a solid rod. However, it will be appreciated that in some instances a tubular inner member 34 may be preferable.

In the preferred embodiment, the inner member 34 is provided with a geometrically-shaped pin end 46 and with a box end 48 forming a geometrically-shaped recess corresponding to the shape of the pin end 46. As used herein, "geometrically-shaped" denotes any configuration that permits the pin end 46 to be slidably received in the box end 48 and yet transmit torque between adjacent inner members 34. The geometrically-shaped pin end 46 and box end 48 of the adjoining member (not shown) prevent rotation of the pin end 46 relative to the box end when thus connected. A preferred geometric shape for the pin end 46 and box end 48 of the inner member 34 is a hexagon. The box end 48 of the inner member 34 may be brazed, forged or welded or attached to the inner member 34 by any suitable means.

Continuing with FIG. 2, the box end 48 of the inner member 34 is disposed within the box end 38 of the outer member 32. It will now be appreciated that the box end 38 of the outer member 32 forms an enlarged internal space 44 for housing the box end 48 of the inner member. This arrangement facilitates easy connection of the dual-member pipe section 30 with the drill string 16 and the rotary drive system 20 in a manner yet to be described.

It is desirable to construct the dual-member pipe section 30 so that the inner member 34 is slidably insertable in and removable from the outer member 32. This allows easy repair and, if necessary, replacement of the inner member 34 or outer member 32. In the assembled dual-member pipe section 30, longitudinal movement of the inner member 34 within the outer member 32 must be restricted. Accordingly, stop devices are provided in the dual-member pipe section 30.

The stop device is preferably comprised of an annular shoulder 50 formed on the inner surface 52 of the outer member 32 to limit longitudinal movement of the inner member 34 within the outer member. In addition, the box end 48 of the inner member 34 forms a shoulder 54 which is larger than the annular shoulder 50. Thus, when the inner member 34 is moved in direction X, the shoulder 54 abuts annular shoulder 50 preventing further movement in that direction.

Longitudinal movement of the inner member in direction Y is restricted by providing a radially projecting annular stop member 56. The pin end 46 of the inner member 34 extends a distance beyond the pin end 36 of the outer member 32. The stop member 56 is disposed near the pin end 46 of the inner member 34 beyond the pin end 36 of the outer member 32. As shown in exploded view in FIG. 2, the radially projecting annular stop member preferably comprises a collar 56 and a set screw or pin 58. When the inner member 34 is moved in direction Y, the stop collar 56 abuts the pin end 36 of the outer member 32 and obstructs further movement.

Figure 3:
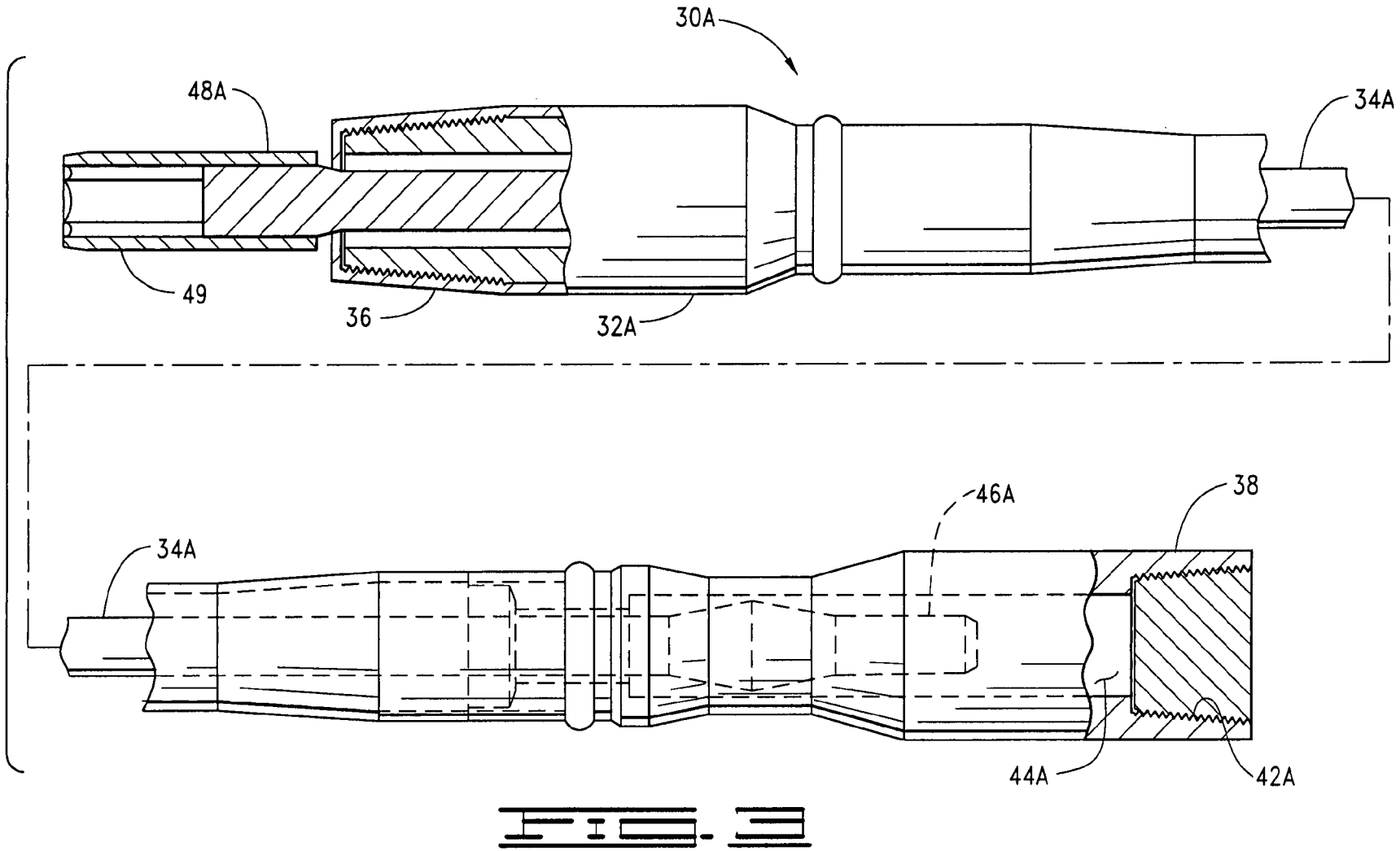
FIG. 3 is a side elevational, partly sectional view of an alternative type pipe section used with a dual-member drill string. In this type of pipe section the pin end and box end on the inner member are reversed.

Turning now to FIG. 3, there is shown an alternative dual-member pipe section 30A comprising the dual-member drill string 16. The pipe section 30A comprises a hollow outer member 32A and an inner member 34A positioned longitudinally therein. The inner member 34A is preferably elongate having a pin end 46A and a box end 48A. As previously described with regard to the dual-member pipe section 30, the pin end 46A and box end 48A may be geometrically-shaped to transmit torque between adjacent pipe sections.

The geometrically-shaped pin end 46A of pipe section 30A is disposed within the box end 38A of the outer member 32A. The box end 38A of the outer member 32A forms an enlarged internal space 44A for receiving the box end 48A of a similarly formed dual-member pipe section.

The inner member 34A is positioned within the outer member 32A so as to extend to an external point beyond the pin end 36A of the outer member. The inner member box end 48A is formed by a geometrically-shaped drive collar 49 connected to the external portion of the inner member 34A. The drive collar 49 is preferably attached to the inner member using a roll pin (not shown), but may be attached to the inner member 34A by any other suitable means. The drive collar 49 has an internal, geometrically-shaped bore which corresponds with the geometrically-shaped pin end 46A of the inner member 34A. It will again be appreciated that use of the geometrically-shaped drive collar 49 provides a connection capable of transmitting torque between adjacent inner members 34A.

Figure 4:
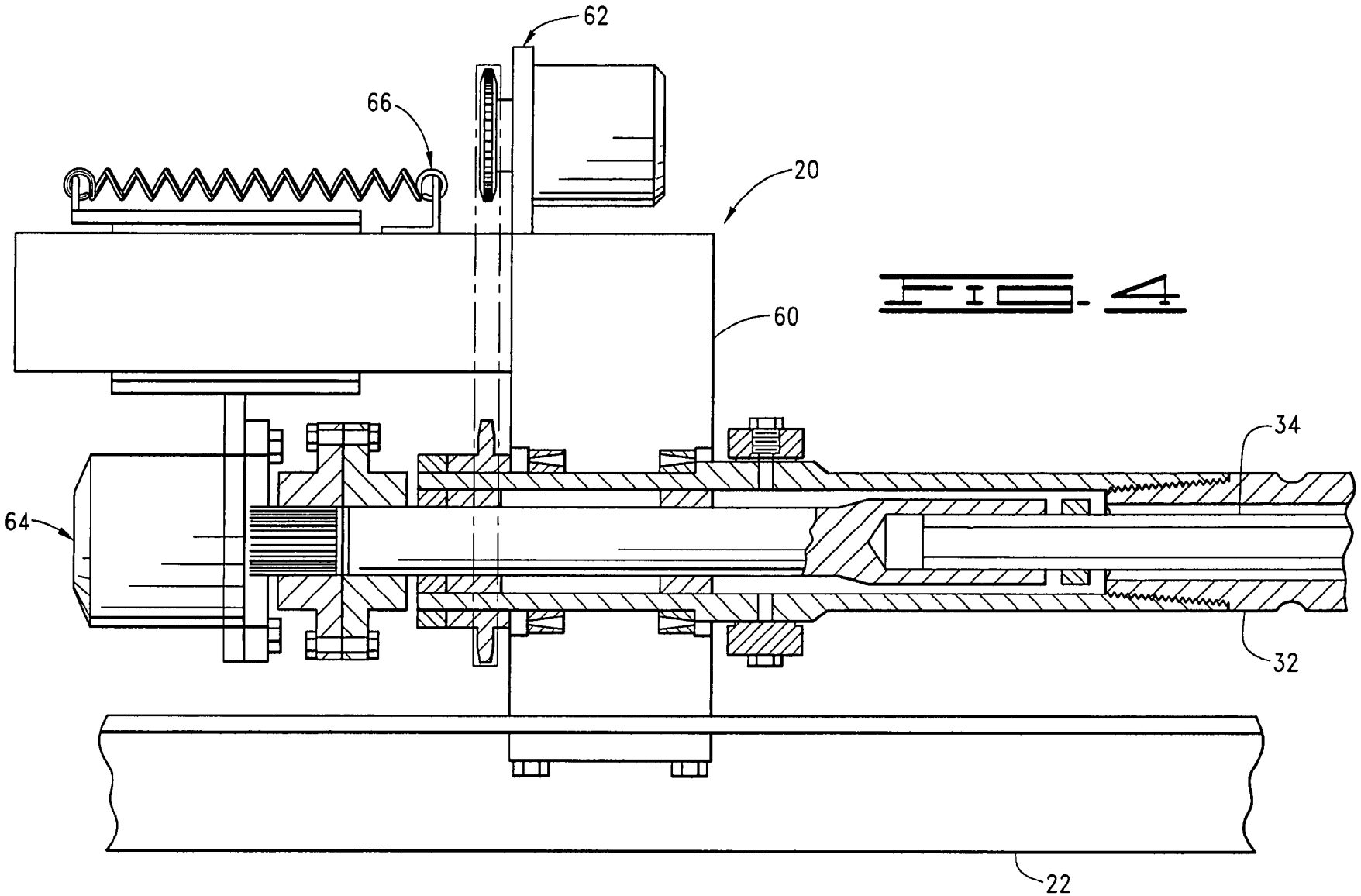
FIG. 4 is a side elevational, partly cross-sectional view of the rotary drive system of the present invention.

Turning now to FIG. 4, the rotary drive system 20 for driving operation of the downhole tool (not shown) is illustrated in more detail. Because the interconnected outer members 32 and interconnected inner members 34 rotate independently of each other, the rotary drive system 20 of the preferred embodiment has two independent drive groups for independently driving the interconnected outer members and interconnected inner members comprising the drill string 16 (FIG. 1).

The rotary drive system 20 thus preferably comprises a carriage 60 supported on the frame 22. Supported by the carriage 60 is an outer member drive group 62 and an inner member drive group 64. The outer member drive group 62 drives the interconnected outer members 32. The inner member drive group 64, also called the inner member drive shaft group, drives the interconnected inner members 34 and the downhole tool 21(not shown). The rotary drive system 20 also comprises a biasing assembly 66 for urging engagement of the inner members. A suitable rotary drive system 20 having an outer member drive group 62 for driving the interconnected outer members 34 and an inner member drive group 64 for driving the interconnected inner members 34 is disclosed in U.S. Pat. No. 5,682,956, which is hereby incorporated by reference in its entirety.

Figure 5:
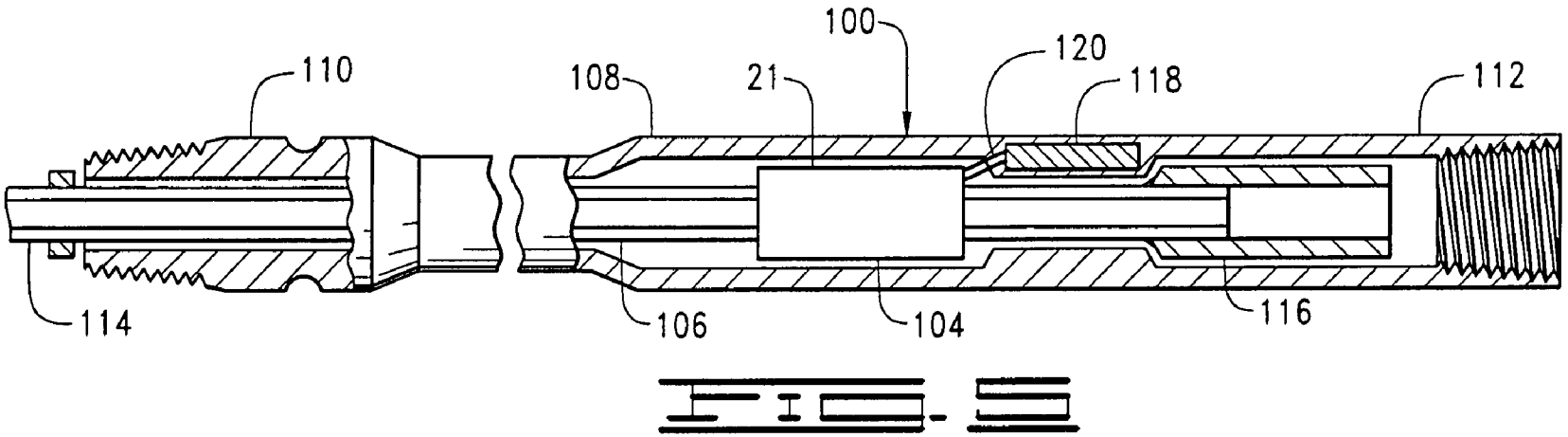
FIG. 5 shows a side elevational, partly sectional view of a dual-member pipe section provided with a downhole tool in accordance with the present invention. The pipe section of FIG. 5 is connectable anywhere along the drill string.

Turning now to FIG. 5 there is illustrated a pipe section assembly 100 in accordance with the present invention, for use with the above-described dual-member drill string 16 (FIG. 1). The pipe section assembly 100 supports a downhole tool 102. In this embodiment the downhole tool 102 comprises a power generator 104. The pipe section assembly 100 is operatively connectable with the inner member 106 so that rotation of the inner member drives operation of the generator 104. The dual-member pipe section 100 supporting the power generator 104 comprises a hollow outer member 108. The inner member 106 is positioned longitudinally within the outer member 108 and is operatively connected to the power generator 104 for operation in response to rotation of the inner member 106. The power generator 104 illustrated in FIG. 5 preferably comprises an electric generator adapted to receive rotational energy from the inner member 106 when the inner member is rotating.

The outer member 108 is preferably hollow having a pin end 110 and a box end 112. Like the dual-member pipe section 30 (FIG. 2), the pin end 110 and box end 112 of the dual-member pipe section assembly 100 are correspondingly threaded to provide a torque-transmitting connection to adjacent, similarly formed outer members of the drill string 16 (FIG. 1). The electric generator 104 is preferably non-rotatably supported within the outer member 108. The electric generator 104 may be affixed to the outer member 108 by any means providing sufficient rigidity to secure the electric generator 104 to the outer member 108 under the load of a rotating inner member 106.

Referring still to FIG. 5, the inner member 106 is elongate and preferably comprises a solid rod disposed longitudinally within the outer member 108 for rotation independently of the outer member. In the preferred embodiment, the inner member 106 is provided with a geometrically-shaped pin end 114 and a box end 116. The box end 116 forms a geometrically-shaped recess corresponding to the shape of the pin end 114 of the inner member 106.

Preferably, the pin end 114 and box end 116 are of appropriate shape and size to allow for a torque-transmitting connection to adjacent dual-member pipe sections. The torque-transmitting connection between the interconnected inner members of the drill string 18 and inner member 106 supplies rotational force necessary to drive the generation of electric power by the electric generator 104.

Use of a rotating inner member to drive a power generator, such as the electric generator illustrated in FIG. 5, provides a sustainable source of electrical energy that may be used in a wide array of drilling components. As shown in FIG. 5, the power generator 104 is electrically connected to a transmitter 118 by way of electrical leads 120. Rotation of the inner member 106 turns the working elements of the electric generator 104 to convert rotation of the inner member into electricity. The electrical current is then passed to the transmitter 118 for further use by the transmitter to relay drilling status information to an above-ground receiver (not shown).

Figure 6:
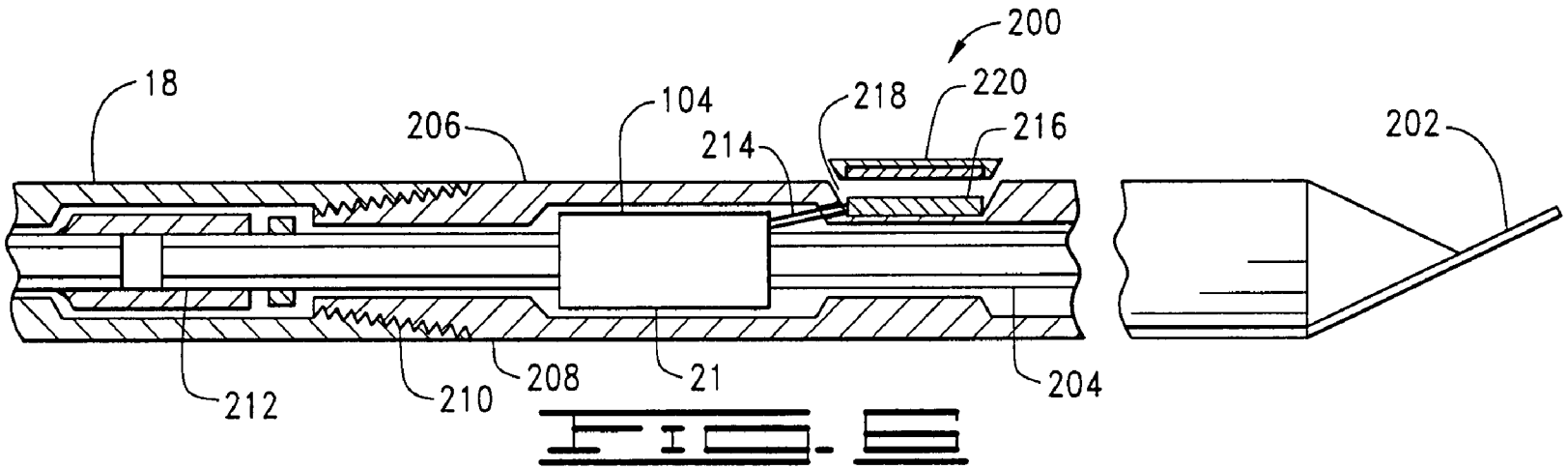
FIG. 6 is a partially broken away, partially sectional view of another embodiment of the pipe section of the invention. The pipe section of FIG. 6 takes the form of a boring head wherein a downhole tool and transmitter are housed therein.

Turning now to FIG. 6, there is illustrated an alternative pipe section assembly of the present invention comprising a boring head 200. The directional boring head 200 preferably comprises a drill bit 202 driven by rotation of the interconnected inner members of the drill string 16 (FIG. 1). The rotary drive system 20 (FIG. 1) acts on the first end 26 of the drill string 16 (FIG. 1) to rotate an inner member 204 which then thrusts and/or rotates the bit 202 to create the borehole 12.

The directional boring head 200 comprises a hollow outer member 206 and the inner member 204 positioned longitudinally therein. The inner member 204 and outer member 206 are rotatable independently of the other. Preferably the outer member 206 is tubular having a pin end 208 comprising external threads 210 for connecting to an adjacent dual-member pipe section. The inner member 204 is preferably elongate comprising a solid rod. At one end the inner member 206 has an geometrically-shaped pin end 212 extending beyond the pin end 208 of the outer member 206. The pin end 212 is adapted for connecting to an adjacent dual-member pipe section having a correspondingly formed box end.

Continuing with FIG. 6, the power generator 104 comprises an electric generator supported within the hollow outer member 206. The power generator 104 is operatively connected to the inner member 204 so that rotation of the interconnected inner members 34 of the drill string (FIG. 2) drives the generation of an electrical charge. To that end, the power generator 104 preferably is adapted to have a torque transmitting geometrically-shaped recess (not shown) for receiving rotational energy from inner member 204. In the present invention, rotation of the inner member 204 within the outer member 206 is capable of driving the power generator 104 to convert rotational energy to electricity while simultaneously driving operation of the bit 202.

Continuing with FIG. 6, electric leads 214 carry generated electricity to a transmitter 216 disposed within a transmitter housing 218. The transmitter 216 can be employed for use with an above-ground receiver (not shown) to track the subterranean location of the directional boring head 200 during drilling or backreaming operations. Placing the transmitter 216 in the directional boring head 200 aids the drilling machine 10 operator in steering the bit 202 by relaying data concerning position, pitch, roll and azimuth from a position in close proximity to the drill bit 202. The transmitter housing 218 is shown in exploded view and comprises a housing cover 220. The housing cover 220 provides for easy access to the transmitter 216 for service or replacement. The electrical current generated by the electric generator 21 provides a generally constant and sustainable source of power for the transmitter 216.

Figure 7:
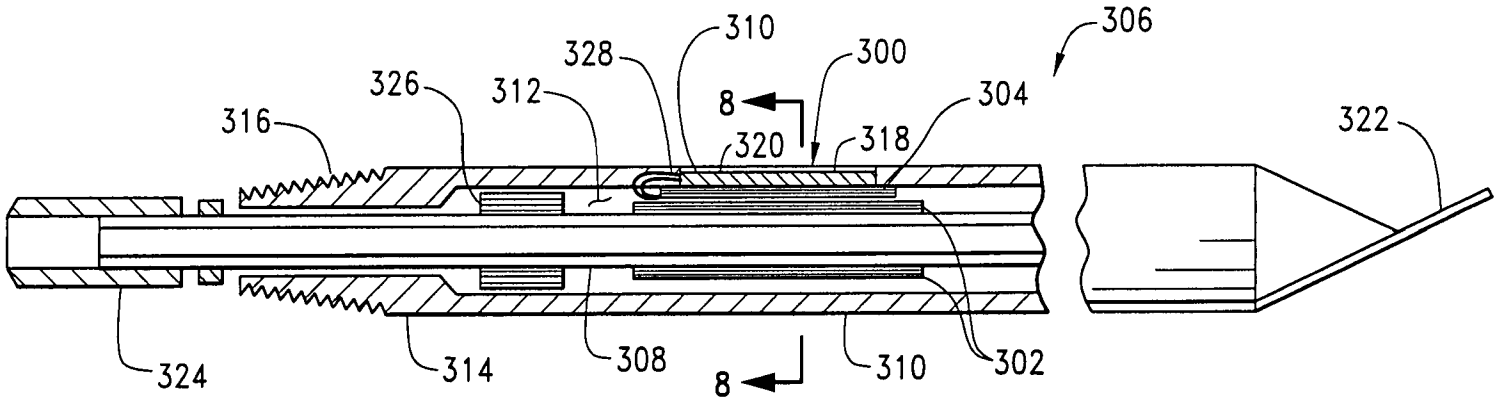
FIG. 7 illustrates another embodiment of the boring head pipe section of the present invention wherein the power generator comprises coils and magnets.
Figure 8:
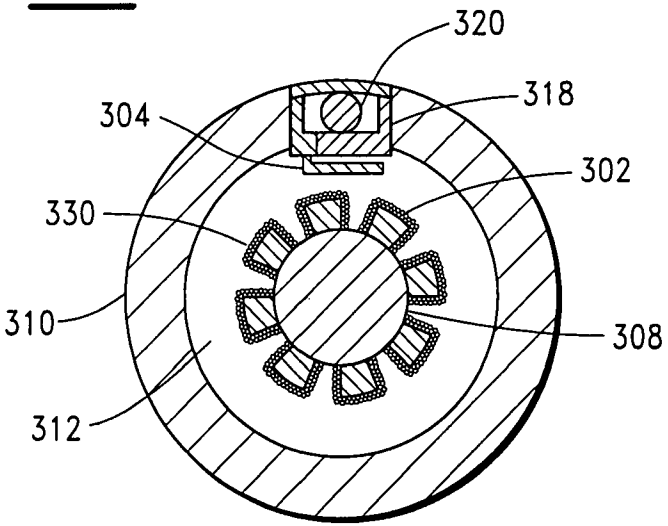
FIG. 8 is a cross-sectional view of the tool head taken along line 8—8 of FIG. 7.
Figure 9:
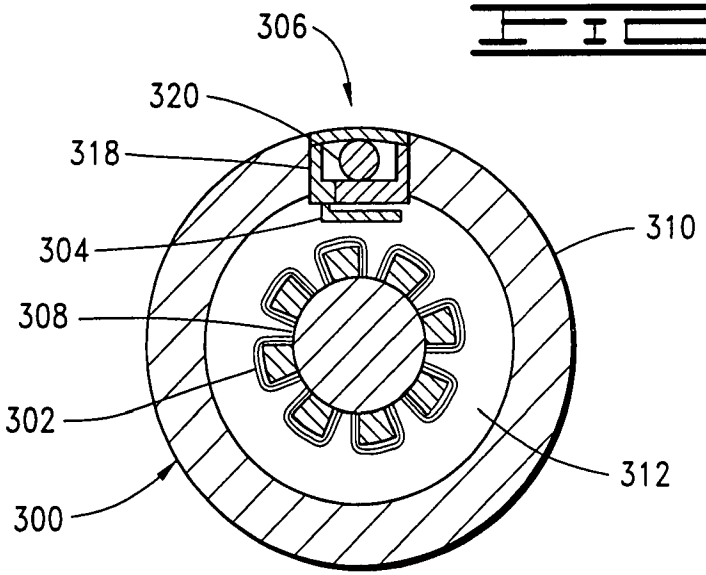
FIG. 9 illustrates an alternative embodiment of the boring head pipe section of FIG. 8 wherein the generator comprises a magnet wrapped in conductive coil.

Turning now to FIGS. 7–9, another embodiment of the pipe section assembly of this invention wherein the pipe section takes the form of a boring head 306. Illustrated in FIG. 7 is the downhole tool 300 comprising at least a magnet 302 and a coil 304, non-rotatably supported by the outer member, to generate an electrical charge. As best seen in FIG. 8, a preferred directional boring head 306 comprises an inner member 308 longitudinally disposed within a hollow outer member 310 for independent rotation therein. The outer member 310 forms a hollow tubular structure enclosing an internal space 312.

Referring now to FIG. 7, the outer member 310 comprises a pin end 314 with external threads 316 for connecting to an adjacent dual-member pipe section. Preferably, the outer member 310 comprises a transmitter housing 318 for supporting a transmitter 320 therein. The transmitter 320 is electrically connectable to the conductive coil 304.

The inner member 308 is integrally formed and comprises a solid rod having an external diameter less than the smallest internal diameter of the outer member 310. The inner member 308 is operatively connected to a bit 322 to drive rotation of the bit. At its other end, the inner member 308 has a geometrically-shaped pin end 324 extending beyond the outer member 310 for connecting to an adjacent dual-member pipe section, such as pipe section 30 (FIG. 2), having a correspondingly shaped box end.

Referring still to FIG. 8, the magnets 302 are supported non-rotatably by the inner member 308 for rotation therewith. Preferably, the magnets 302 are placed equidistant around the circumference of the inner member 308. Additionally, a plurality of bearings 326 are supported on the inner member 308 to ensure centered rotation of the inner member within the outer member 310.

In operation, the plurality of magnets 302 supported on the inner member 308 are rotated within the outer member 310 so that movement of the magnets 302 excites the conductive coil 304 to create an electric charge. The voltage and current generated by the downhole tool 300 depends upon the speed of rotation at which the magnets 302 are driven and on the intensity of the magnetic field. It is preferable to supply the transmitter 320 with a constant voltage and thus ensure effective operation of the transmitter at all times, despite variations in rate at which the inner member 308 is rotated within the outer member 310. To achieve this, a regulating device 328 may be employed to vary the current that energizes the coil in such a manner that the output voltage of the downhole tool 300 is kept constant.

Turning now to FIG. 9, there is illustrated an alternative embodiment of power generator. The power generator has a similar construction as the power generator 300 of FIG. 8, but further comprises a second coil 330 disposed around the magnet 302 for rotation therewith. The use of second conductive coils 330 increases the magnetic field emitted by the magnets 302. Now it will be appreciated that as the conductive coil 304 passes through the enlarged magnetic field created by rotating the inner member 308, a greater voltage and current are created.

Figure 10:
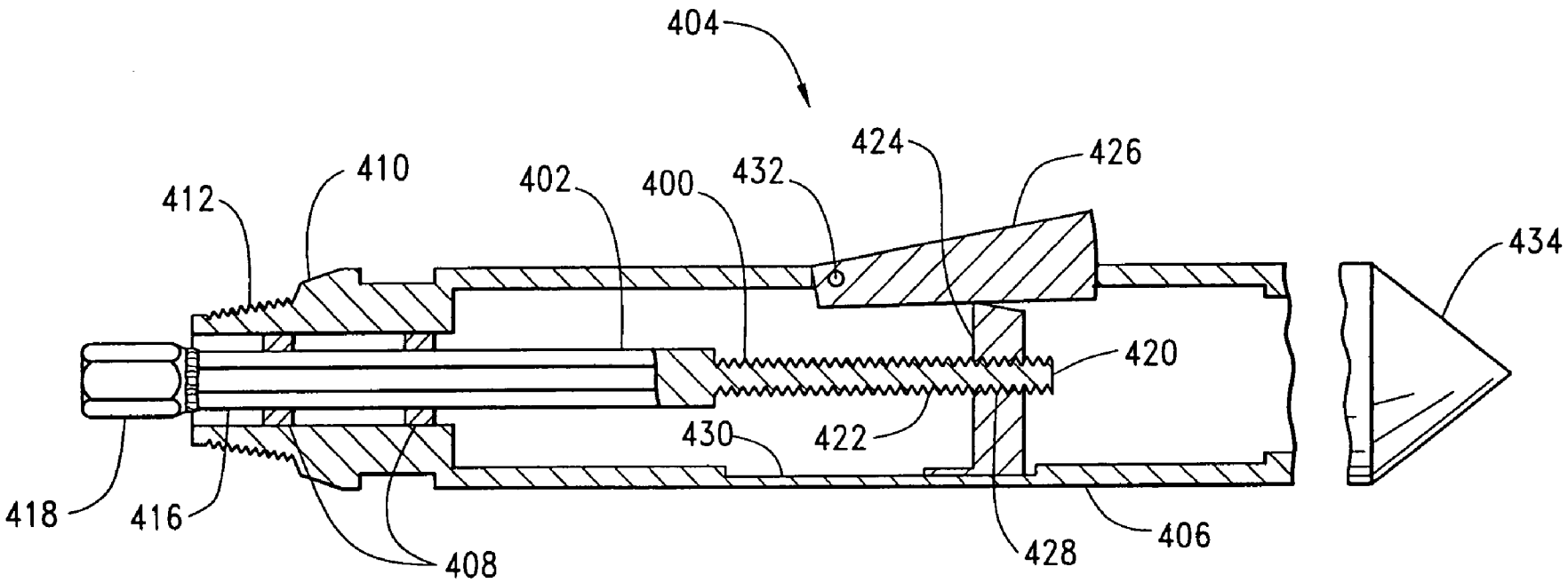
FIG. 10 illustrates an alternative embodiment of the boring head pipe section wherein the downhole tool is a screw drive for operating a steering member pivotally mounted to the pipe section.

Turning now to FIG. 10, there is shown yet another alternative embodiment of a pipe section assembly comprising a steerable boring head constructed in accordance with the present invention. In this embodiment the boring head has a symmetrical bit and the downhole tool comprises a mechanical transmission for laterally extending a steering member. The mechanical transmission comprises a screw drive system 400 for converting rotation of the interconnected inner members 34 or 34A into radial force.

The screw drive system 400 is operatively connected to a dual-member pipe section and comprises a hollow outer member 406 having an inner member 402 longitudinally supported within the outer member for rotation therein. The inner member 402 is supported by bearings 408 for fixed rotation within the hollow outer member 406. The outer member 406 comprises a pin end 410 having external threads 412 for connecting to the box end 38 (FIG. 2) of a correspondingly threaded dual-member pipe section.

Referring still to FIG. 10, at its first end 416, the inner member 402 may comprise a geometrically-shaped box end 418 for connection with the correspondingly shaped pin end 48A (FIG. 3) of the inner member 34A (FIG. 3) of a dual-member pipe section.

The second end 420 of the inner member 402 comprises a screw 422. The screw 422 is operatively connectable to a cam 424 for operating a steering member 426. The cam 424 has an internal bore 428 to threadedly receive the screw 422. The cam 424 is non-rotatably supported by the outer member 406 and movable between a first position and a second position in response to rotation of the inner member 402. The cam 424 is slidably supported within the outer member 406 by elongate recess 430. Recess 430 promotes limited axial movement of the cam 424 and prohibits rotation of the cam within the outer member 406. Axial movement of the cam 424 to the first position causes the cam to laterally extend the steering member 426.

The steering member 426 is pivotally bolted to the outer member 406 by threaded bolt 432 which permits replacement of the steering member 426, when worn. Use of a threaded bolt 432 permits pivotal movement of the steering member 426 between the steering position and the non-steering position in response to rotation of the interconnected inner members.

In operation, the interconnected outer members of the drill string are rotated by the rotary drive system 20 (FIG. 1). As the boring head is pushed forward by the biasing assembly 60 (FIG. 1), the drill bit 434 will cut into the exposed face of the borehole 12 (FIG. 1). To change the angle at which the symmetrical drill bit engages the exposed face of the borehole, and thus steer the drill bit, the interconnected outer members are rotated to orient the drill string steering member 426 within the borehole 12 (FIG. 1). Once the steering member is properly oriented, the interconnected inner members are rotated. This moves the cam 424 to force the steering member 426 to move to the steering position.

The steering member 426 will thereafter cause the boring head to move in the desired direction.

Once the drill string has been axially advanced and the boring angle altered as desired, the interconnected inner members may be rotated in a second direction to retract the steering member 426. This allows the advancing boring head 404 to resume a straight path.

Figure 11:
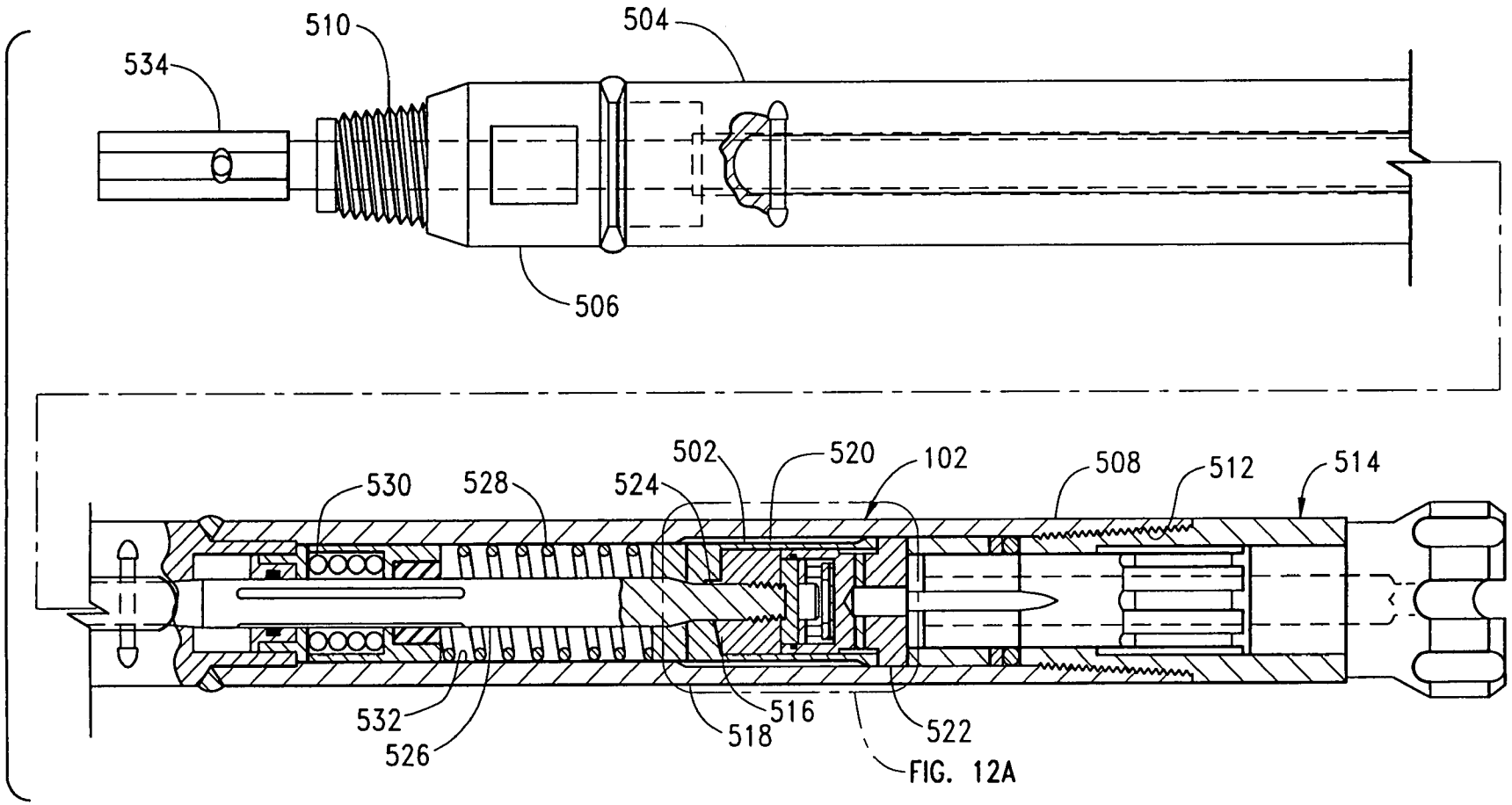
FIG. 11 illustrates the boring head pipe section of the present invention wherein the downhole tool is a mechanical hammer.

Turning now to FIG. 1, yet another embodiment of the present invention will be described. Illustrated in FIG. 11 is a boring head pipe section of the present invention wherein the downhole tool is a mechanical hammer. The downhole tool 102 comprises a hammer assembly 502. As seen in FIG. 1, the preferred system for converting rotation of the inner member into axial force comprises the rotary-driven hammer assembly 502. The boring head comprises an outer member or tool housing assembly 504 having a pin end 506 and a box end 508. The pin end 506 has external threads 510 for connecting to the corresponding internal threads 42A (FIG. 3) of the outer member of an adjacent dual-member pipe section 30A (FIG. 3). The box end 508 comprises internal threads 512 for connecting the tool housing assembly 504 to a hammer tool 514.

Figure 12A:
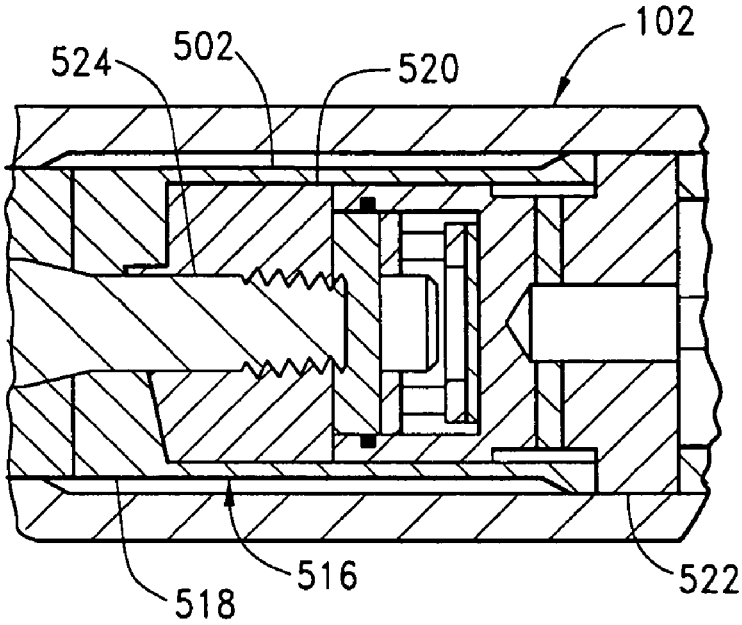
FIG. 12A is an enlarged view of the tool head taken from within the dashed circle of FIG. 11 wherein the cam faces are together.
Figure 12B:
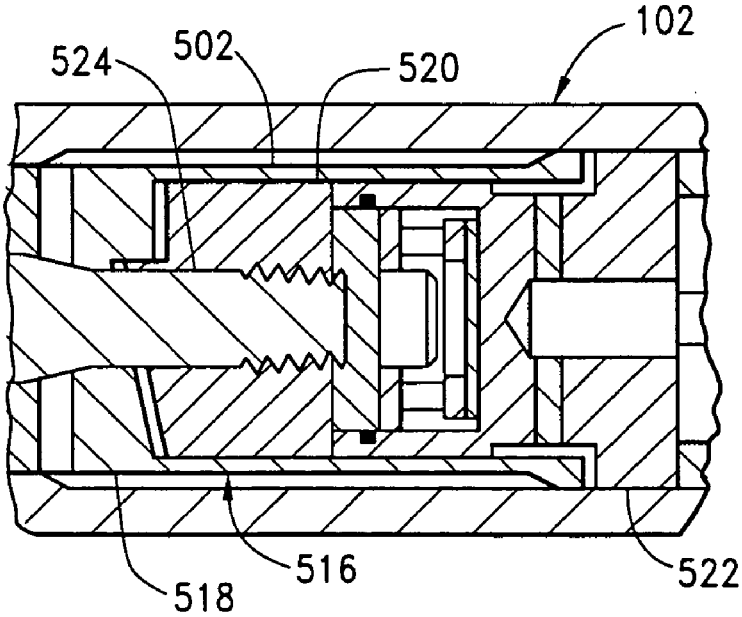
FIG. 12B is an enlarged view of the tool head taken from within the dashed circle of FIG. 11 showing the cam faces are in an alternative orientation.
Figure 7:
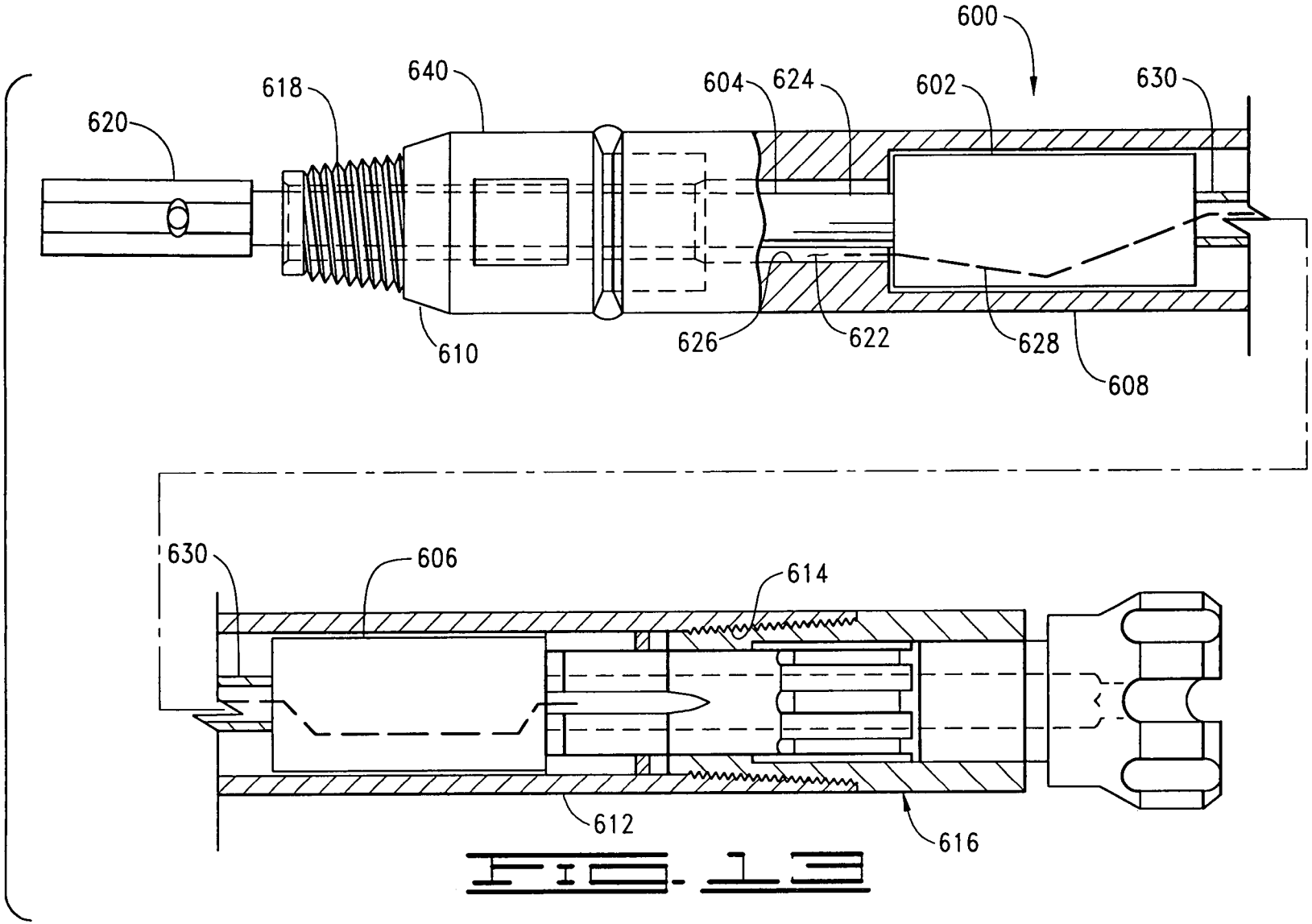

Continuing with FIG. 11 and now FIG. 12, the rotary-driven hammer assembly 502 is preferably a cam assembly 516. The cam assembly 516 comprises an upper cam 518, also called a piston, adapted to matingly interface a lower cam 520. The upper cam 518 impacts the anvil 522 as the lower cam 520 is rotated relative to the upper cam 518. The lower cam 520 is threadedly connected to the lower end 524 of an inner member 526. The lower cam 520 and upper cam 518 have opposing, eccentrically-contoured interengaging faces. In this way, rotation of the one against the other forces the faces a distance apart (FIG. 12B) then quickly back together when the faces are matingly aligned (FIG. 12B). The interengaging faces are forced together by springs 528 positioned within the tool housing assembly 504 to engage the upper cam 518.

The inner member 530 is rotated by the rotary drive system 20 (FIG. 1) to drive rotation of the lower cam 520. Rotation of the lower cam 520 separates the opposing faces of cams 518 and 520 while compressing springs 528. After one revolution, the opposing faces of cams 522 and 528 are thrust together under the force of the springs 528. Thrusting the cams 518 and 520 together causes the upper cam 518 to impact the anvil 522, thus creating the desired axial force. The anvil 522 communicates impacts from the upper cam 518 to the hammer tool 514 connected to the tool housing assembly 504.

The inner member 526 is rotatably mounted within the tool assembly housing 504. Bearings 530 encourage rotation of the inner member 526 parallel to, but spaced from the inner surface 532 of the tool assembly housing 504. Preferably, the inner member 526 has a geometrically-shaped box end 534 extending beyond the pin end 506 of the housing 504. The box end 534 is formed so that it is connectable to the pin end 48A (FIG. 3) of adjacent dual-member pipe sections. As previously discussed, using a geometrically-shaped box end 534 allows for efficient connection of the inner member 526 to the drill string 16 and facilitates torque transmission down the drill string 16.

Turning now to FIG. 13, there is illustrated therein an alternative embodiment of the pipe section of the present invention. The pipe section 600 comprises a bent sub having a hydraulic pump 602 for converting rotational energy from the inner member into hydraulic power. As seen in FIG. 13, the hydraulic pump 602 is rotatably driven by an inner member 604 to generate hydraulic power for driving a hydraulic hammer unit 606.

Continuing with FIG. 13, the hydraulic pump 602 and hammer unit 606 are housed within the pipe section 600. The pipe section 600 comprises a housing 608 having a tail piece 610 at one end and a box end 612 at the other. The box end 612 comprises internal threads 614 for connecting the housing to a hammer tool 616.

The tail piece 610 forms a pin end having external threads 618 for connecting to the corresponding internal threads 42A of the outer member 32A of an adjacent dual-member pipe section 30A (FIG. 3). The tailpiece 610 may be connected to the housing 608 at a slight angle, preferably between 1° and 3°. The angle between the tailpiece 610 and the housing 608 will produce an off-center orientation of the hammer tool 616 within the borehole 12 (FIG. 1). Steering is accomplished by advancing the tool axially without rotating the housing 608.

The inner member 604 is rotatably mounted within the housing 608. The inner member 602 has a drive collar 620 connected to the external portion of the inner member 604. The drive collar 620 is formed to provide a torque-transmitting connection to the pin end 48A (FIG. 3) of adjacent dual-member pipe sections. Use of the drive collar 620, having an internally formed geometrically-shaped recess, allows for efficient connection of the inner member 604 to the adjacent pipe sections comprising the drill string 16 and facilitates torque transmission down the drill string. Now it will be apparent that the use of a geometrically-shaped recess to connect the interconnected inner members 34A of the drill string 16 to the pipe section 600 is preferred, but may be accomplished by other means.

A fluid passage 622 is formed between the external wall 624 of the inner member and the inner wall 626 of the housing 608 for transporting drilling fluid to the hydraulic pump 602. Drilling fluid is passed from the boring machine, through the housing 608, into the hydraulic pump 602, where it is pressurized for use by the hydraulic hammer unit 606. Rotation of the inner member 604 is used by the hydraulic pump 602 to create the fluid pressure necessary to drive the hydraulic hammer unit 606. Pressurized fluid flows, as shown by the dashed line 628, through a conduit 630 to the hydraulic hammer unit 606.

Now it will be appreciated that because the interconnected outer members and interconnected inner members are rotatable independently of each other, the operator (not shown) may control operation of the hydraulic hammer unit 604 independently of the bit 620. In operation, the interconnected inner members are rotated independently of the interconnected outer members to operate the hydraulic hammer unit 604 and thus provide the fracturing action necessary to create the borehole 12.

The present invention also comprises a method for generating power using a horizontal directional drilling machine 10. In accordance with the method of the present invention, power is generated within a borehole 12 using a downhole tool 21 operatively connected to a drill string 16. The horizontal directional drilling machine is comprised of the drill string 16, having a first end and a second end, and a rotary drive system 20 attached to the first end of the drill string 16. A downhole tool is supported within the drill string 16 to convert rotational energy from the drill string into either electric or hydraulic power. Preferably one of the downhole tools, 21, 21A or 21B as described herein may be used for this purpose. The drill string 16 comprises a plurality of dual-member pipe sections 30. The dual-member pipe sections 30 each comprise a hollow outer member 32 and an inner member 34 as previously described. The outer members 32 and inner member 34 are connectable to corresponding outer members 32 and inner members 34 of adjacent dual-member pipe sections 30 to form a drill string comprising interconnected inner members which are rotatable independently of the interconnected outer members.

Having determined the need for generating power inside a borehole, the downhole tool 21 is attached to the drill string 18. The interconnected inner members are then rotated and the downhole tool converts rotation of the inner member of at least one of the pipe sections into output power. The output power is then communicated to a power hungry downhole component such as a steering mechanism, sonde, drill bit, or the like.

In accordance with the present method, a steering mechanism my be attached to one of the outer members to change the direction of advance of the directional boring head. Thus, the present invention is capable of simultaneously selectively rotating the outer members of the drill string to position the steering mechanism, rotating the inner member to actuate the steering member 424 (FIG. 10), and rotating the directional boring head to create the borehole.

It will now be apparent that the increased output power provided by the present invention makes possible the use of more sophisticated control systems to enhance the overall drilling process, or selected elements thereof. Use of rotational energy to operate downhole tools could be used for power-hungry digital signal processing chips, for example, and can be employed for bi-directional transmission of data to and from the transmitter.

It will of course be realized that various modifications can be made in the design and operation of the present invention without departing from the spirit thereof. Thus, while the principal preferred construction and modes of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A horizontal directional drilling machine comprising:

a rotary drive system;

a dual-member drill string operatively connected to the rotary drive system;

wherein the dual-member drill string comprises a hollow outer member and an inner member positioned longitudinally therein, wherein the inner member is movable independently of the outer member; and at least one downhole tool supported within the outer member of the dual-member drill string so that movement of the inner member will drive operation of the downhole tool.

2. The horizontal directional drilling machine of claim 1 wherein the drill string comprises a plurality of dual-member pipe sections, each dual member pipe section comprising a hollow outer member and an inner member positioned therein, wherein the outer member is connectable with the outer members of adjacent pipe sections, wherein the inner member of the pipe section is connectable with the inner members of adjacent pipe sections.

3. The horizontal directional drilling machine of claim 1 wherein the downhole tool comprises a power generator operable in response to movement of the inner member of the drill string relative to the outer member of the drill string.

4. The horizontal direction drilling machine of claim 3 further comprising a processor powered by the power generator.

5. The horizontal direction drilling machine of claim 4 wherein the processor is adapted to transmit at least a control signal used to control operation of the rotary drive system.

6. The horizontal directional drilling machine of claim 4 further comprising an orientation sensor and wherein the processor is adapted to process an orientation signal from the orientation sensor.

7. The horizontal directional drilling machine of claim 3 further comprising an obstacle avoidance system powered by the generator.

8. The horizontal direction drilling machine of claim 3 further comprising a transceiver powered by the generator and adapted to transmit and receive data.

9. The horizontal directional drilling machine of claim 3 further comprising a regulator adapted to maintain an output of the power generator at a substantially constant level.

10. The horizontal directional drilling machine of claim 3 wherein the power generator comprises a hydraulic pump.

11. The horizontal directional drilling machine of claim 10 further comprising a hydraulic hammer assembly unit supported by the drill string and operable in response to hydraulic pressure generated by the hydraulic pump.

12. The horizontal directional drilling machine of claim 1 wherein the drill string comprises an uphole end and a downhole end, wherein a boring head is supported at the downhole end of the drill string and operable in response to movement of the inner member of the drill string.

13. The horizontal directional drilling machine of claim 12 further comprising a bent-sub supported at the downhole end of the drill string, wherein the bent-sub is positionable in response to movement of the outer member of the drill string.

14. The horizontal directional drilling machine of claim 12 wherein the outer member of the drill string comprises a steering member adapted to steer the boring head.

15. The horizontal directional drilling machine of claim 14 further comprising a processor and at least an orientation sensor, adapted to detect an orientation of the boring head and to transmit an orientation signal to the processor, wherein the processor processes the orientation signal and transmits a control signal to actuate the steering member.

16. The horizontal directional drilling machine of claim 1 further comprising a steering member supported by the outer member of the drill string, wherein the steering member is extendable from the outer member of the drill string in response to movement of the inner member.

17. The horizontal directional drilling machine of claim 1 wherein the downhole tool comprises a transmission.

18. The horizontal directional drilling machine of claim 17 wherein the transmission is adapted to convert a rotational movement of the inner member of the drill string into axial force.

19. The horizontal directional drilling machine of claim 1 wherein the downhole tool comprises an electric generator and wherein the drilling machine further comprises a transmitter supported by the drill string and electrically connected to the electric generator.

20. A method for drilling a borehole using a horizontal directional drilling machine, the machine including a rotary drive system attached to a drill string having a hollow outer member and an inner member positioned longitudinally therein, wherein the inner member is movable independently of the outer member, the method comprising:

moving the inner member; and converting movement of the inner member into an output power within the hollow outer member of the drill string.

21. The method of claim 20 wherein a boring head is attached to the drill string, the method further comprising:

axially advancing the boring head; and rotating the boring head with the inner member of the drill string.

22. The method of claim 20 wherein a steering mechanism is operatively supported on the outer member of the drill string, the method comprising:

controlling the direction of the drill string by selectively rotating the outer member of the drill string to position the steering mechanism for a period of axial advance.

23. The method of claim 22 further comprising activating the steering mechanism in response to movement of the inner member of the drill string.

24. The method of claim 22 further comprising activating the steering mechanism in response to a control signal transmitted from the horizontal directional drilling machine.

25. The method of claim 21 wherein the horizontal directional drilling machine comprises an orientation sensor and a processor both disposed within the boring head, wherein the orientation sensor is adapted to detect the orientation of the boring head, the method comprising powering the orientation sensor and the processor with the output power.

26. The method of claim 25 further comprising processing an orientation signal from the orientation sensor to control operation of the boring head.

* * * * *